US005189988A

United States Patent [19]

Budin et al.

[11] Patent Number: 5,189,988

[45] Date of Patent: Mar. 2, 1993

[54] PROCESS FOR STARTING UP A HEAT EXCHANGER SYSTEM FOR STEAM GENERATION AND HEAT EXCHANGER SYSTEM FOR STEAM GENERATION

[75] Inventors: Kurt Budin; Georg Gasteiger, both of Vienna, Austria

[73] Assignee: SGP-VA Energie- und Umwelttechnik Gesellschaft m.b.H., Vienna, Austria

[21] Appl. No.: 744,929

[22] Filed: Aug. 13, 1991

[30] Foreign Application Priority Data

Aug. 27, 1990 [AT] Austria ..... 1755/90

[51] Int. Cl.[5] ..... F22D 5/26

[52] U.S. Cl. ..... 122/6 A; 122/451 S; 122/406.4

[58] Field of Search ..... 122/1 B, 6 A, 414, 451 S

[56] References Cited

U.S. PATENT DOCUMENTS

| | | | |
|---|---|---|---|
| 3,205,869 | 9/1965 | Pescatore | 122/451 S |
| 3,942,483 | 3/1976 | Laubli | 122/451 S |
| 4,290,390 | 9/1981 | Juzi | 122/451 S |
| 4,520,762 | 6/1985 | Martin | 122/406 S |
| 4,869,210 | 9/1989 | Wittchow | 122/406 S |

FOREIGN PATENT DOCUMENTS 3741882 3/1990 Fed. Rep. of Germany .

OTHER PUBLICATIONS

"Festigkeitsberechnung von Bauelementen des Dampfkessel-Behaelter- und Rohrleitungsbaues", Siegfried Schwaigerer, 2nd Edition, 1970, pp. 59 and 60.

*Primary Examiner*—Henry C. Yuen
*Attorney, Agent, or Firm*—Beveridge, DeGrandi, Weilacher & Young

[57] ABSTRACT

The invention relates to a process for starting up a heat exchanger system for the generation of steam accommodated in a hot gas line, in particular in an exhaust gas line, conveniently in a waste heat boiler, for instance downstream from a gas turbine, for instance for starting up a circulation system steam generator or a continuous flow (once-through) steam generator, conveniently a natural or forced circulation boiler or once-through boiler, in particular a preheater/evaporator/superheater system provided with a start-up heat exchanger upstream via which the supply of feed medium, in particular water or steam, is effected, and which on start-up dispenses first hot steam and finally water to the heat exchanger system, so that the initially pressureless, void heat exchanger system substantially heated to hot gas temperature is continuously brought to its operative state and its operating temperature, as well as a corresponding heat exchanger system. The process is mainly characterized in that the start-up heat exchanger is filled with feed medium in the cold state and subsequently charged with hot gas. The apparatus is mainly characterized in that the start-up heat exchanger (2) is at least partially, conveniently virtually completely, separable from the hot gas stream, the start-up heat exchanger serving in particular as an auxiliary steam generator for starting up the entire system from the cold state.

26 Claims, 2 Drawing Sheets

Figure 2:
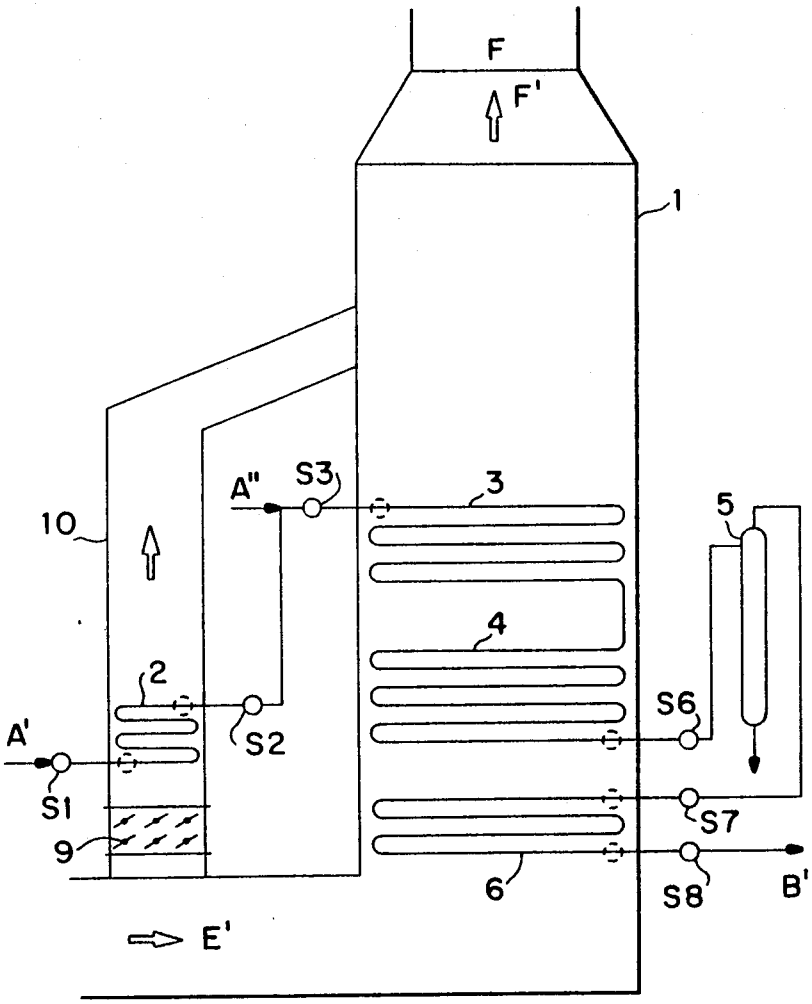

PROCESS FOR STARTING UP A HEAT EXCHANGER SYSTEM FOR STEAM GENERATION AND HEAT EXCHANGER SYSTEM FOR STEAM GENERATION

The present invention relates to a process for starting up a steam generating heat exchanger system accommodated in a hot gas line, in particular an exhaust gas line, conveniently in a waste heat boiler, for instance downstream from a gas turbine, for instance of a circulation system steam generator or a continuous flow (once-through) steam generator, conveniently a natural or forced circulation boiler or once-through boiler. In particular the present invention relates to a process for starting up a heat exchanger system that preferably includes a preheater/evaporator/superheater system provided with a start-up heat exchanger upstream via which the supply of feed medium, in particular water or steam, is effected and which on start-up dispenses first hot steam and finally water to the heat exchanger system, so that the initially pressureless, void heat exchanger system substantially heated to hot gas temperature is continuously brought to its operative state and its operating temperature, as well as a corresponding heat exchanger system. The heat exchanger system may comprise one single heat exchanger or two heat exchangers with a start-up heat exchanger disposed upstream.

A process and an apparatus of this type are described in DE-PS 3 741 882.

The start-up heat exchanger in this known apparatus is constantly connected to the hot gas and is thus at least substantially maintained at hot gas temperature like the other heat exchangers of the void heat exchanger system. It is conceived as a heat accumulator of high storage capacity as a system of concentric pipes mobile in relation to one another for compensating different thermal expansion on feeding water at the start-up of the steam generating system. It is mentioned in this publication that it would do no harm if for instance the inner pipe of the system, where the water is fed, would break during this moving. The start-up heat exchanger according to this publication has the serious drawback that on start-up, the water flowing through damages or destroys the protective coating in the inlet zone due to the considerable temperature differences and thus causes that in particular iron is entrained into the boiler system, which also jeopardizes the heat exchanger system.

It was now found that these drawbacks can be avoided without difficulty without any intricate heat exchanger design by proceeding in reverse, namely by not starting the hot, heat-storing start-up heat exchanger with water, but instead starting a cold start-up heat exchanger with hot gas.

The process according to the invention is thus mainly characterized in that the start-up heat exchanger is charged in the cold state with feed medium and subsequently charged with hot gas. This means in practice that the start-up heat exchanger is charged with water or steam, the temperature being substantially lower than for instance the temperature of the exhaust gas of a gas turbine (in most cases more than 500° C.). The start-up heat exchanger is thus subsequently charged, "in the cold state", with hot gas.

According to a further characterizing feature of the process according to the invention, the amount of hot gas and/or feed medium, in particular water or gas, fed to the start-up heat exchanger is controlled in the start-up state in such a manner that no thermal shock occurs when the feed medium, in particular the water or steam, is introduced into the heat exchanger system heated to hot gas temperature. Thermal shock is understood to mean the stress exerted on the material of the heat exchanger system by sudden temperature changes on the structural elements subjected to pressure. (also see S. SCHWAIGERER "Festigkeitsberechnung von Bauelementen des Dampfkessel-, Behälter- und Rohrleitungsbaues, 2nd edition, 1970, pages 59/60). The preferred feed medium is above all cold water.

The heat exchanger system according to the invention for steam generation is accommodated in a hot gas line, in particular an exhaust gas line, conveniently in a waste heat boiler, for instance downstream from a gas turbine, for instance a circulation system steam generator or a continuous flow (once-through) steam generator, conveniently a natural or forced circulation boiler or once-through boiler, in particular a preheater-/evaporator/superheater system provided with a start-up heat exchanger upstream via which the supply of feed medium, in particular water or steam, is effected and which on start-up first dispenses hot steam and finally water to the heat exchanger system pressureless and void and substantially brought to hot gas temperature on start-up; the heat exchanger system is mainly characterized in that the start-up heat exchanger is at least partially, conveniently virtually completely, separable from the hot gas stream, the start-up heat exchanger particularly serving as an auxiliary steam generator for the start-up of the entire system from the cold state.

The start-up heat exchanger is accommodated in particular in the hot gas line and shieldable against the hot gas stream by means of flaps or the like; another convenient possibility is to dispose the start-up heat exchanger in a secondary line of the hot gas line, the secondary line being openable and closable by means of flaps or the like and having a substantially smaller passage cross section, of for instance about 25 percent of the total cross section, as compared to the hot gas line.

It is further convenient that an additional water and/or steam feed is provided downstream from the start-up heat exchanger, so that the start-up heat exchanger can be inactivated after starting up the operation.

The invention can be realized in any given heat exchanger system, preferred is a closed system in which the condensate formed of the generated steam subsequent to work output and cooling is recycled as feed water; it is further suitable for any given steam generating system such as once-through, natural or forced circulation.

Figure 1:
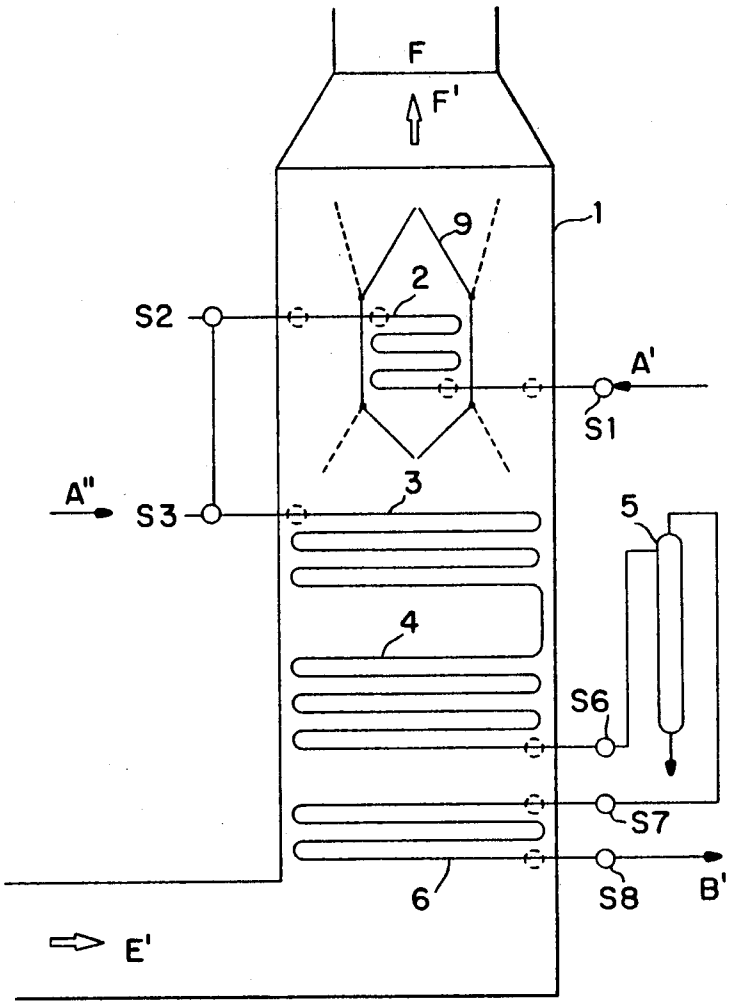
Figure 4:
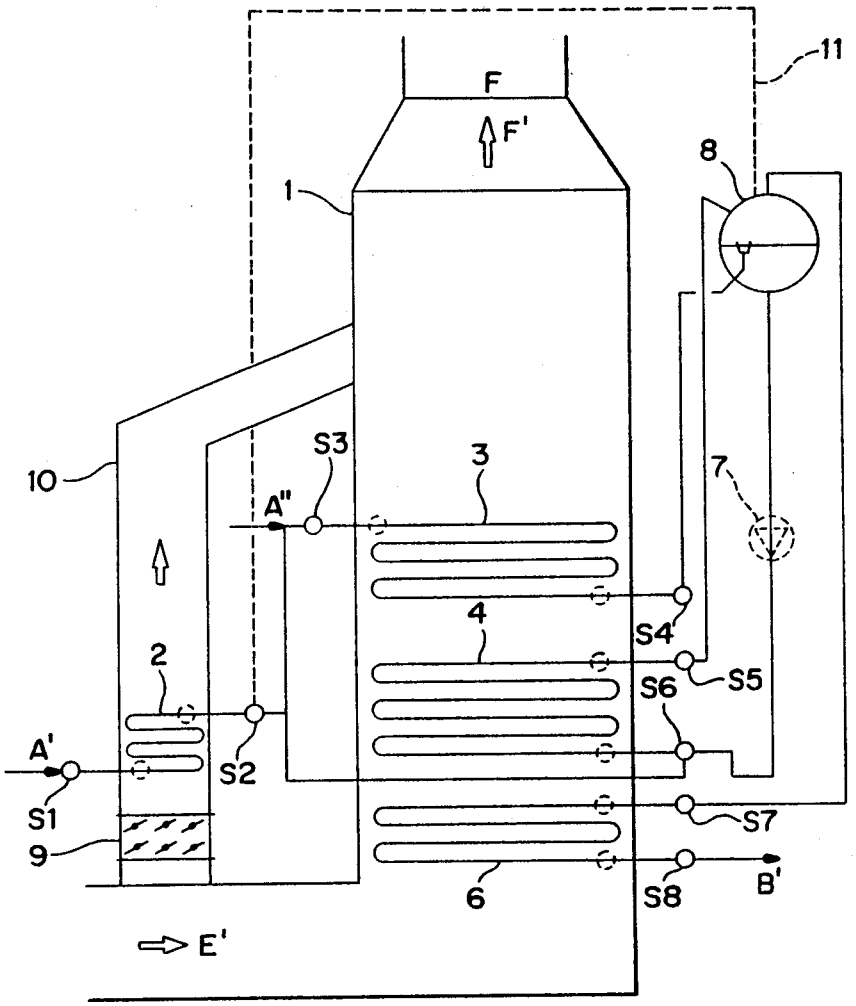
Figure 3:
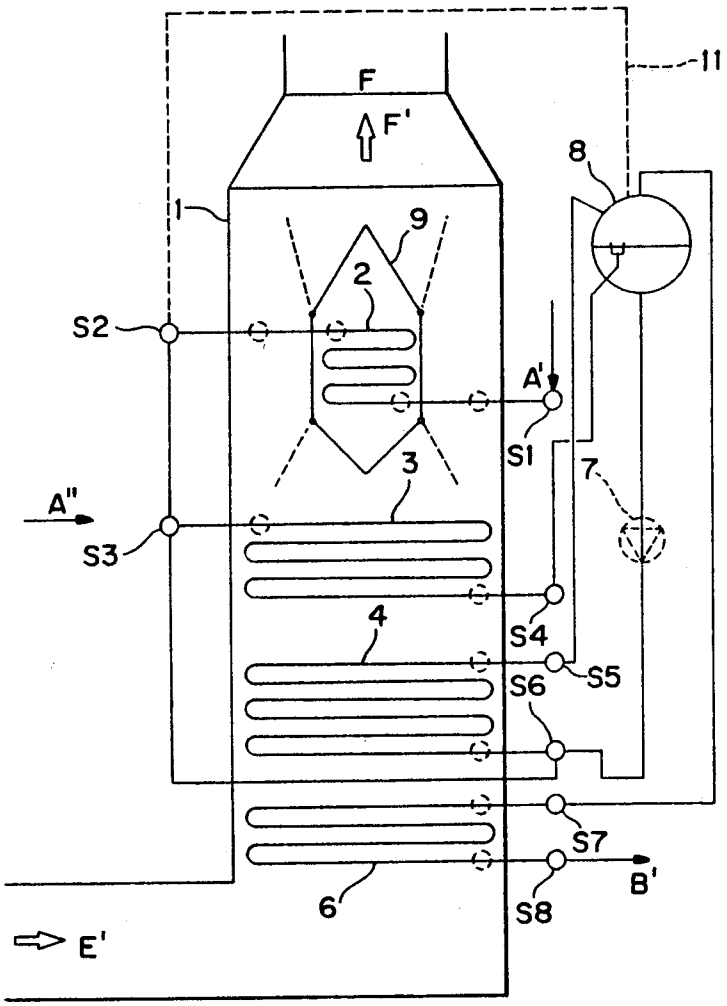

The invention is explained in detail in the following on the basis of various exemplary embodiments with reference to the drawing diagrammatically showing heat exchanger systems for steam generation, in other words so called waste heat boilers, accommodated in a hot gas line, without the energy converter (for instance steam turbine) or energy consumer (for instance heater) disposed downstream. In FIGS. 1 to 4 of the drawing, like structural elements are provided with identical reference symbols; the embodiments according to FIGS. 1 and 2 are once-through steam generators, the embodiments according to FIGS. 3 and 4 are circulation heaters, a conventional preheater/evaporator/-superheater system being superimposed in a chimneylike hot gas line 1 (gas feed arrow E', gas discharge arrow F') in which the hot gas is brought in contact in a known manner first with the superheater 6, then with the evaporator 4 and finally with the preheater 3, all of them being conventional boiler heat exchangers. In the embodiments according to FIGS. 1 and 2, a collector S6, a trap 5 and a collector S7 are provided between evaporator 4 and superheater 6; the steam discharged from the superheater 6 passes via the collector S8 in the direction of arrow B' to the consumer. The drawing shows that individual ones or all of the collectors can be arranged within or out of the flue gas stream.

Feeding of the system is effected in the direction of arrow A' with water (or steam) via a collector S1 into a start-up heat exchanger 2 connected to the preheater 3 via collectors S2 and S3. In the embodiment according to FIG. 1, the start-up heat exchanger 2 is disposed above the preheater 3 in the hot gas line 1 and shieldable against the hot gas stream by means of flaps 9 or the like. It is evident that the system according to FIG. 1 is basically fed via the collector S1, a further special feature being the provision of a further feeding site A" between the collectors S2 and S3.

On starting the void system, the start-up heat exchanger shielded against the hot gas stream is first charged with steam or water and the shielding flaps are opened so that the hot gas comes into contact with the start-up heat exchanger. The position of the shielding flaps and/or the feeding of the start-up heat exchanger 2, and/or both, are mutually adjusted in such a manner that the start-up heat exchanger dispenses hot steam to the preheater 3 at the beginning of the start-up stage and warm water at the end of the start-up stage, so that the system cools from the hot, void state to its operative state in which hot steam is not formed until the feed medium reaches the superheater.

In the operative state, the shielding flaps 9 can remain open or closed; the start-up heat exchanger then acts as a preheater; the heating surfaces of the ECO could then be formed appropriately smaller.

In the embodiment according to FIG. 2, the start-up heat exchanger 2 is provided in a branch line 10 of the hot gas line 1. The branch line 10 is closable by means of flaps 9. A further special feature represented in FIG. 1 is a further feed site A" between the collectors 52 and 53 via which for instance additional medium may be metered in on start-up or which is a single feed site for feed water; in the second case, the branch line 10 normally remains closed and the start-up heat exchanger is not fed.

The embodiments according to FIGS. 3 and/or 4 substantially correspond to the embodiments according to FIGS. 1 and/or 2; the difference merely resides in their configuration as circulation system with a boiler drum 8.

In the operative state of the embodiments according to FIGS. 3 and 4, water is passed from the preheater 3 via the collectors S4 into the boiler drum 8 from where it passes to the collector 56, for which purpose a pump 7 is provided if required, and from there into the evaporator 4 and via the collector S5 into the steam chamber of the boiler drum 8 from where it passes via collector S7 to superheater 6 and is discharged from there as industrial steam via collector S8 in the direction of arrow B' to the consumer.

A bridging line 11 for the controlled preheating of the drum 8 may be provided between the steam chamber of boiler drum 8 and the collector S2 adjacent the start-up heat exchanger 2 in flowing direction. This bridging line 11 can also serve for feeding auxiliary steam into the auxiliary steam system of the installation for starting the installation, so that no extraneous medium is required for this purpose.

As already mentioned, any given boiler system can be equipped with the start-up heat exchanger assembly according to the invention, the invention is thus not limited to the embodiments represented. The water/steam circuit can be closed in a manner known per se, i.e. exhaust steam and/or exhaust water can be recycled from the consumer to the heat exchanger system.

We claim:

1. A process for the starting up of a steam generator heat exchanger system which system includes a start-up heat exchanger and a second heat exchanger positioned, with respect to feed medium flow, in line and downstream from said start-up heat exchanger, and said start-up heat exchanger and said second heat exchanger being positioned for contact with hot gas passing in a hot gas line, comprising:

inputting feed medium at temperature $T_1$ to said start-up heat exchanger;

heating said start-up heat exchanger and feed medium contained therein by subjecting said start-up heat exchanger to a hot gas at a temperature greater than $T_1$ such that feed medium exiting said start-up heat exchanger is at temperature $T_2$ which is higher than $T_1$;

inputting the feed medium exiting said start-up heat exchanger at temperature $T_2$ to said second heat-exchanger; and varying the temperature of the feed medium exiting said start-up heat exchanger and being inputted to said second heat exchanger such that the temperature of the feed medium is lowered gradually from temperature $T_2$ to an operating temperature $T_3$ so as to avoid thermal shock in said heat exchanger system.

2. A process as recited in claim 1 further comprising the step of shielding said start-up heat exchanger from contact with the hot gas prior to the step of inputting feed medium to said start-up heat exchanger such that there is less of a temperature differential between the feed medium being inputted into start-up said heat exchanger and the temperature of said start-up heat exchanger.

3. A process as recited in claim 2 wherein said step of shielding includes diverting the hot gas away from the start-up heat exchanger with adjustable flaps.

4. A process as recited in claim 1 further comprising the step of introducing feed medium through a second feed medium introduction conduit and into said second heat exchanger while by-passing said start-up heat exchanger after the feed medium exiting said start-up heat exchanger has reached operative temperature $T_3$.

5. A process as recited in claim 4 wherein the step of introducing the feed medium through the second feed medium introduction conduit includes introducing feed medium into a feed medium communication line extending between the start-up exchanger and said second heat exchanger.

6. A process as recited in claim 1 wherein said heat exchanger system further includes a third and a fourth heat exchanger, with the second heat exchanger being a preheater, said third heat exchanger being an evaporator and said fourth preheater being a superheater, and said start-up heat exchanger being positioned downstream in hot gas flow direction from said second, third and fourth heat exchangers and in a common hot gas line with said second, third and fourth heat exchanger, and said step of varying the temperature of the feed medium exiting said start-up heat exchanger includes adjusting flaps positioned both upstream and downstream of said start-up heat exchanger.

7. A process as recited in claim 1 wherein said heat exchanger system further includes a third heat exchanger and a fourth heat exchanger, with the second heat exchanger being a preheater, said third heat exchanger being an evaporator and said fourth heat exchanger being a superheater, and said second, third and fourth heat exchangers being positioned in a common main hot gas line and said start-up heat exchanger being positioned in an auxiliary hot gas line which opens at both ends into said main hot gas line, and said step of varying the temperature of the feed medium exiting said start-up heat exchanger includes adjusting a flap positioned between one end of said auxiliary hot gas line and said start-up heat exchanger which is positioned in said auxiliary line downstream in hot gas flow direction from said flap.

8. A process as recited in claim 7 wherein said step of varying the temperature of the feed medium exiting said start-up heat exchanger includes varying the degree of contact between the hot gas and said start-up heat exchanger by adjusting said flap such that hot gas from the main line enters the auxiliary line and the hot gas entering the auxiliary line is about ¼ of the total amount of hot gas traveling upstream of the auxiliary line inlet.

9. A process as recited in claim 1 wherein said heat exchanger system includes a boiler drum which is in fluid communication with said second heat exchanger so as to receive feed medium exiting said second heat exchanger, and wherein said process for the start-up of a heat exchanger system includes passing steam through a bridging line extending between a first position downstream in fluid medium flow direction from said start-up heat exchanger and upstream from said second heat exchanger and a second position which places said bridging line in fluid communication with said boiler drum.

10. A process as recited in claim 1 wherein said feed medium being inputted to said start-up heat exchanger $T_1$ is water, and said feed medium, upon exiting said start-up heat exchanger at temperature $T_2$, is steam.

11. A process as recited in claim 10 wherein said inputting of said feed medium at temperature $T_3$ to said second heat exchanger involves inputting warm water to said second heat exchanger.

12. A process as recited in claim 11 wherein said start-up heat exchanger is shielded from said hot gas prior to inputting of the water at temperature T1 and then said start-up heat exchanger is subjected to the hot gas in a manner which heats said start-up heat exchanger and feed medium contained therein together to higher temperature $T_2$.

13. A process as recited in claim 11 wherein shielding of said start-up heat exchanger and subsequently subjecting said start-up heat exchanger to the hot gas includes opening flaps positioned upstream of said start-up heat exchanger such that the amount of hot gas contact is raised.

14. A process as recited in claim 1 wherein varying the temperature of the feed medium exiting said start-up heat exchanger includes varying the degree of hot gas in contact with said start-up heat exchanger.

15. A process as recited in claim 14 wherein varying the temperature of the feed medium exiting said start-up heat exchanger includes varying the feeding of feeding medium to said start-up heat exchanger.

16. A process as recited in claim 14 wherein varying the degree of hot gas in contact with said start-up heat exchanger includes varying the position of flaps positioned in line with the hot gas and upstream of said start-up heat exchanger.

17. A process as recited in claim 1 wherein varying the temperature of the feed medium exiting said start-up heat exchanger includes varying the feeding of feeding medium to said start-up heat exchanger.

18. A process as recited in claim 1 wherein said heat exchanger system includes a main gas line and an auxiliary hot gas line which opens at both ends into said main hot gas line, said start-up heat exchanger being positioned in said auxiliary line and said second heat exchanger being positioned in said main line, and wherein varying the temperature of fluid medium exiting said start-up heat exchanger includes varying the percentage of hot gas passing through said auxiliary line and main line.

19. A process as recited in claim 18 wherein varying the temperature of the fluid medium exiting said start-up heat exchanger includes adjusting flaps positioned in said auxiliary line between the auxiliary line inlet and said start-up heat exchanger.

20. A process as recited in claim 18 wherein upon said fluid medium reaching temperature $T_3$ the inlet of said auxiliary line is closed so as to direct the hot gas only within the main hot gas line.

21. A process as recited in claim 11 further comprising the step of introducing feed medium through a second feed medium introduction conduit and into said second heat exchanger while by-passing said start-up heat exchanger after the feed medium charged into said start-up heat exchanger has changed from steam to warm water.

22. A process as recited in claim 15 further comprising the step of introducing feed medium through a second feed medium introduction conduit and into said second heat exchanger while by-passing said start-up heat exchanger after the feed medium inputted into said start-up heat exchanger has changed from temperature $T_2$ to operative temperature $T_3$.

23. A process for the starting up of a steam generator system which system includes a start-up heat exchanger and a second heat exchanger positioned, with respect to feed medium flow, in line and downstream from said start-up heat exchanger, and said start-up heat exchanger and second heat exchanger being positioned for contact with hot gas passing in a hot gas line, comprising:

shielding a start-up heat exchanger positioned within the hot gas line so as to maintain said start-up heat exchanger below the temperature of the hot gas;

inputting a feed medium into said start-up heat exchanger which has a temperature $T_1$ which is below that of said hot gas;

reducing the degree of shielding of said start-up heat exchanger subsequent to the introduction of said feed medium at temperature $T_1$ such that both said start-up heat exchanger and feed medium contained therein are heated to a higher temperature;

directing said feed medium from said start-up heat exchanger to said second heat exchanger following the reduction of said shielding and the heating of said feed medium such that the temperature of said feed medium, which is initially directed from said start-up heat exchanger to said second heat exchanger while said second heat exchanger is in a void state, is at temperature $T_2$ which is sufficiently close to said second heat exchanger temperature so as to avoid thermal shock; and varying the temperature of said feed medium being directed from said start-up heat exchanger to said second heat exchanger such that the temperature of said feeding medium drops from temperature $T_2$ to operating temperature $T_3$.

24. A process as recited in claim 23 wherein said varying of the temperature of said feed medium from $T_2$ to $T_3$ includes adjusting feeding of feed medium to said start-up heat exchanger.

25. A process as recited in claim 24 wherein said varying of the temperature of said feed medium from $T_2$ to $T_3$ includes a variation in the shielding of said start-up heat exchanger.

26. A process as recited in claim 23 wherein said varying of the temperature of said feed medium from $T_2$ to $T_3$ includes a variation in the shielding of said start-up heat exchanger.

* * * * *